US006195174B1

(12) United States Patent
Johnson et al.

(10) Patent No.: US 6,195,174 B1
(45) Date of Patent: Feb. 27, 2001

(54) METHOD AND SYSTEM FOR PRINTING A MAIL LIST IN PRESORT ORDER ON MULTIPLE PRINTERS

(75) Inventors: Robert J. Johnson, Naugatuck; Gabriel E. Pettner, Orange, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/001,071

(22) Filed: Dec. 30, 1997

(51) Int. Cl.[7] ..... B41B 15/00

(52) U.S. Cl. ..... 358/1.18; 358/1.18; 209/657; 209/540; 351/1.13; 351/1.1-1.8

(58) Field of Search ..... 395/117; 364/464.2, 364/478; 358/1.18; 209/657, 540; 271/178, 181; 351/1.13, 1.1–1.8

(56) References Cited

U.S. PATENT DOCUMENTS

| | | | | |
|---|---|---|---|---|
| 4,853,869 | | 8/1989 | Durst et al. | 364/478 |
| 4,853,882 | | 8/1989 | Marshall | 364/570 |
| 4,858,907 | | 8/1989 | Eisner et al. | 271/124 |
| 4,862,386 | | 8/1989 | Axelrod et al. | 364/818 |
| 4,907,161 | | 3/1990 | Sansone et al. | 364/464.02 |
| 5,043,908 | * | 8/1991 | Manduley et al. | 364/478 |
| 5,053,955 | | 10/1991 | Peach et al. | 364/401 |
| 5,175,691 | | 12/1992 | Baker et al. | 364/478 |
| 5,262,597 | | 11/1993 | Johnson, Jr. | 177/50 |
| 5,264,665 | | 11/1993 | Delfer | 177/25.15 |
| 5,278,947 | | 1/1994 | Balga et al. | 395/117 |
| 5,321,604 | | 6/1994 | Peach et al. | 364/401 |
| 5,326,181 | | 7/1994 | Eisner et al. | 400/104 |
| 5,329,102 | | 7/1994 | Sansone | 235/375 |
| 5,459,670 | | 10/1995 | Johnson et al. | 364/478 |
| 5,469,362 | | 11/1995 | Hunt et al. | 364/478 |
| 5,486,055 | | 1/1996 | Oka | 400/61 |
| 5,583,970 | | 12/1996 | Strobel | 395/114 |
| 5,812,401 | * | 9/1998 | Moore | 705/410 |

* cited by examiner

*Primary Examiner*—Edward L. Coles
*Assistant Examiner*—Twyler Lamb
(74) *Attorney, Agent, or Firm*—Charles R. Malanadra, Jr.; Michael E. Melton

(57) ABSTRACT

The invention is a method and system for printing a mail list in presort order, on a plurality of printers. The method begins with the preparation of a mail list within an addressing system. The mail list is presorted in accordance with postal service requirements. The presorted mail list is then divided into batches by container type. Container type is determined by selecting from among container types generally available to a mailer and which are in conformance with postal service regulations for containing presorted mail. The maximum mailpiece capacity of the container defines the point at where the presorted mail list is divided. After division into batches, the mail list is then directed to the printers for printing to envelopes. Each of the printers is selected based upon the batches that are to be printed and are configured to print based upon a container type corresponding to the batch. The batch size equals the corresponding container's capacity. The printer pauses after completion of the batch printing and notifies a system user that the batch has been printed. The printer does not print a next batch until allowed to do so by the system user. The system user can monitor the status of the process by referring to a monitor. Once printed, the batch of mailpieces is placed into its corresponding container, and the container is delivered to the postal service. In an alternative embodiment, direction of the print stream to the printers is accomplished by an external print director.

17 Claims, 7 Drawing Sheets

METHOD AND SYSTEM FOR PRINTING A MAIL LIST IN PRESORT ORDER ON MULTIPLE PRINTERS

BACKGROUND OF THE INVENTION

The invention disclosed herein is generally concerned with a method and system for printing addresses to mailpieces within an addressing system. More specifically, the invention supports more than one printer connected to a host microprocessor where each printer is configured to print an address batch based upon a defined postal service container type.

Mailpiece production systems are an example of systems whose purpose is to utilize address lists, perform addressing hygiene through the use of address correction techniques, perform presort or manifesting to qualify for postal service discounts and, download data to printers, collators, sealers, and the like for the purpose of producing a mailpiece. Mailpiece production systems are known in the art and have developed with changes in postal service regulations (such as those of the United States Postal Service, or USPS) and with the proliferation of appropriate software applications. In turn, this production has served the need to automate and accelerate to accommodate growth.

As the USPS, together with the postal services of other countries around the world, moves toward more fully automated mail handling in an effort to contain costs while processing ever increasing volumes of mail, automated equipment which sorts and processes mail on the basis of machine readable postal codes, such as the "zip code" or other forms of postal coding, play an ever more significant role. In the United States, postal service regulations provide for a "Postnet" bar code which represents the five, nine, or eleven digit zip code of the destination address in a machine readable form.

Systems have been used or proposed to meet the need to produce mail pieces imprinted with the Postnet bar code, and to enable mailers to obtain the benefit of the discounts offered for such mail. One such system is described in U.S. Pat. No. 4,858,907, for a SYSTEM FOR FEEDING ENVELOPES FOR SIMULTANEOUS PRINTING OF ADDRESSES AND BAR CODES, issued to Eisner et al. (hereinafter referred to as Eisner-1) on Aug. 22, 1989. This patent discloses a system for printing envelopes with addresses, zip codes, and corresponding bar codes. The system is controlled by a computer which includes software for converting a zip code included in the address into bar code form and then adding the bar code representation to the material to be printed on the envelope.

Another example of the art is found in U.S. Pat. No. 5,326,181 for an ENVELOPE ADDRESSING SYSTEM ADAPTED TO SIMULTANEOUSLY PRINT ADDRESSES AND BAR CODES; issued on Jul. 5, 1994 to Eisner et al. (hereinafter referred to as Eisner-2). This patent teaches a method of addressing substrates with a human readable address containing a zip code and a bar code corresponding to the zip code. The method utilizes a computer and comprises several steps. These steps include: receiving in the computer a plurality of addresses, with pre-existing zip code information contained in each as complete address data, and requiring no manual inputting or identification; automatically scanning the address data in the computer to find the pre-existing zip code; automatically converting, in the computer, the pre-existing zip code into a line of corresponding bar code; and, essentially simultaneously printing the complete address, including zip code information and corresponding bar code, on a substrate, under control of the computer so that the substrate produced has human readable zip code and machine readable bar code information thereon.

Additionally, a system for printing envelopes with addresses including bar code is disclosed in commonly assigned U.S. Pat. No. 5,175,691 for a SYSTEM AND METHOD FOR CONTROLLING AN APPARATUS TO PRODUCE ITEMS IN SELECTED CONFIGURATIONS; issued on Dec. 29, 1992 to Baker et al. (hereinafter referred to as Baker), which describes a system for printing mail pieces which includes a printer for printing sheets and envelope forms and a folder-sealer mechanism for folding the envelope form around the sheets to form a mail piece, and a computer based control system for controlling the printer and folder. In the system of this application, when an operator is creating a file of letters to be printed, the operator may designate a selected field within each letter as containing the destination address. The system will then extract the information in this designated field and with it create a new page of material to be printed on the envelope form; and, if the address within the designated field includes a zip code, the system will add a corresponding barcode to the new page. The system then adds this new page to the file before the file is output.

U.S. Pat. No. 5,278,947 for a SYSTEM FOR AUTOMATIC PRINTING OF MAIL PIECES; issued Jan. 11, 1994 to Balga, Jr. et al. (hereinafter referred to as Balga), and assigned to the assignee of the present claimed invention, is for a system which includes a printer for printing text in response to the input of signals. The printer has a capability to selectively print either sheets or envelopes. The system further includes a controller for output of s a sequence of signals representative of materials to be printed on a sheet which forms part of the mail piece, where the sequence includes a subset of signals representative of an address.

In accordance with another aspect of the Balga invention, the system includes a scanning mechanism for identifying a character string which conforms to a valid postal coding standard. The system further includes a mechanism for identifying the character string as a valid postal code. Additionally, the system forms the destination address to include a line including the postal code and a selected number of proceeding lines of text.

The ability to structure software coding is extremely important when linking data to be downloaded to a printer being utilized in the addressing environment. U.S. Pat. No. 5,583,970 for a PRINTER COMMAND SET FOR CONTROLLING ADDRESS AND POSTAL CODE PRINTING FUNCTIONS, issued Dec. 10, 1996 to Strobel (hereinafter referred to as Strobel), and assigned to the assignee of the present claimed invention, is instructive in this respect.

Strobel is a method and system for printing images to a substrate wherein the commands normally input by an operator, or resident within the printer, can be determined at a host data processor. The system can control address and postal code printing functions beginning at the host computer together. The system will derive printing data, including address data, from a selected application resident in the host computer. The host computer creates and then transmits printer command sets and printing data, via transmitting means to a microprocessor within the printer. The microprocessor drives a language interpreter which directs the printer commands to a parsing step for determining the address location from within the data to be printed. The language interpreter then assigns delivery point digits to a zip code that was isolated from the transmitted address data. The newly created zip code is then matched with the bar code data stored within the microprocessor's corresponding memory. A bar code corresponding to the new zip code is selected. The language interpreter then directs the printer's controller to prepare to print the address with its corresponding zip code, any graphics images that may have been included within the print data, and text, if any. The printer controller positions the bar code for printing, and then prints the bar code and address data, zip code, and any graphics images and text to an envelope or other substrate.

Thus, Strobel overcame the limitations of the prior art by providing flexibility in determining what data, and how much, may be downloaded for printing to a substrate. Flexibility is accomplished by controlling address and postal coding functions in the printer from a host computer. The invention thus simplifies the firmware required in a selected printer, or can allow the performance of additional tasks or provide for greater database functionality under the direction of the printer microprocessor. Thus, printer ROM memory can be reduced or freed up for other tasks, and RAM memory can be increased to handle more detailed data.

With the optimization of the component parts of addressing systems, comes the ability to utilize those parts in new and increasingly efficient ways to qualify for the discounts available from the postal service.

One of the discount areas available to mailers utilizing postal services is for placing mail in Presort order. Presort order optimizes postal service time management and handling capabilities. The mailer who prepares mailpieces in Presort order can further optimize their own performance by utilizing an addressing system that not only prepares address lists in Presort order for printing as is possible with the SmartMailer product from Pitney Bowes Inc. of Stamford, Conn., but directs the addressing system to send the address data print stream to more than one printer based upon container requirements. This data stream direction causes the printers to be more effectively utilized and the speed capability of the overall system to be optimized based upon both the Presort and container requirements of the postal service.

Therefore, it is an object of the present invention to provide for a method and system of conforming to postal service Presort and container requirements while optimizing the ability of an addressing system and its constituent printers.

SUMMARY OF THE INVENTION

The limitations of the prior art are overcome by a method and system for printing a mail list in presort order, on a plurality of printers.

The method begins with the preparation of the mail list within an addressing system. Addressing systems of this type, generally comprise: a microprocessor; a memory; an addressing software application; a monitor under control of the addressing software application; and communication means for communicating with one or more devices peripheral to the microprocessor. The addressing system is capable of accepting a set of data, wherein the set of data is representative of one or more addresses; and, is further capable of combining a plurality of addresses, input from one or more data sources, to form the mail list. The system can be further capable of preparing the mail list by combining the set of address data with previously accepted data to form the mail list.

Upon preparation of the mail list, the list is presorted in accordance with pre-defined postal service requirements which are generally based upon a postal service defined code, such as a zip code, assigned to each of the addresses within the list. The presorted mail list is then divided into batches by container type.

Container type is determined by selection, within the application program, from among a number of factors which include: material type; class of mail; size of the mail piece; and, weight of the mail piece. The container types are in conformance with postal service regulations for containing presorted mail. The maximum mailpiece capacity of the container defines the point at where the presorted mail list is divided.

After division into batches, the mail list is then directed to the printers for printing to envelopes. Each of the printers is selected based upon the batches that are to be printed and are configured to print based upon a container type corresponding to the batch. The batch size equals the corresponding container's capacity as defined by the postal service.

The printer pauses after completion of the batch printing and notifies a system user that the batch has been printed. The printer does not print a next batch until allowed to do so by the system user. Once printed, the batch of mailpieces is placed into its corresponding container, and the container is delivered to the postal service.

During the printing process, the system user can monitor the status of the process by referring to a monitor connected to the system. Under control of the addressing software application, the monitor displays a plurality of status indicators, wherein which can include: status of each of the plurality of printers; a sequence number for each of the containers awaiting placement of the printed batch of mailpieces; a sequence number for each of a set packages which are sub-batch components; a sequence number for each envelope being printed by each of the printers; and a sequence number representing the total number of envelopes placed in each of the containers.

In an alternative embodiment of the present invention, direction of the print stream to the printers is accomplished by an external buffered print director. The print director is operatively connected to the addressing system and further comprises: connecting means for connecting the print director to the addressing system; connecting means for connecting the print director to each of the printers; communication means for communicating with the addressing system; communication means for communicating with each of the printers; and, direction means for directing the batch of mailpieces to be printed by the particular printer based upon its corresponding container.

DETAILED DESCRIPTION OF THE PREFERRED EMBODIMENTS

Figure 1:
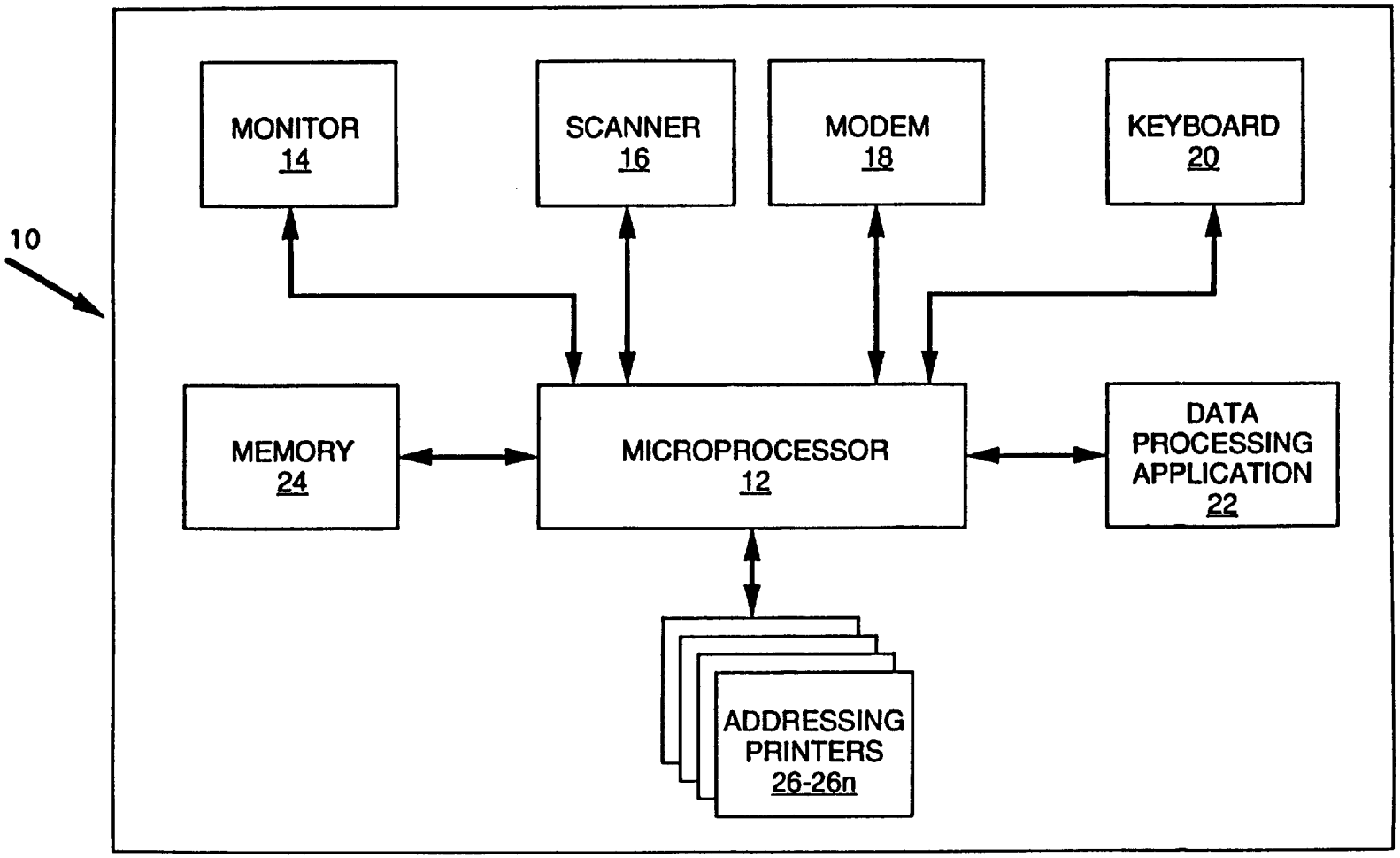
FIG. 1 is a block diagram of a typical system within which the method of the present invention can reside and be utilized.

Turning to FIG. 1, there is shown a block diagram of a typical addressing system 10 within which the method of the present invention could reside and be utilized.

System 10 comprises a microprocessor 12 interoperatively connected to monitor 14 for viewing the address data being collected to form the mail list. The viewing of the address data on monitor 14 promotes ease of use in word and data processing, and provides an example of the human interface that can be brought to system 10. The monitor 14, under control of the data processing application 22, is able to show the system user: the status of each printer; current container number; current package number; current envelope number; and number of envelopes in a container. Microprocessor 12 is interoperatively connected to scanner 16. Scanner 16 provides system 10 with the ability to scan address field data, barcodes, or other scannable data sources as an input to data processing application 22. Addressing printers **26–26*n* are also interoperatively connected to microprocessor 12 and serve as the output devices by which address data is printed to a substrate such as envelopes. Additionally, keyboard 20 is interoperatively connected to microprocessor 12 and serves as an input device for the creation of documents or the input of data. Modem 18 gives system 10 the ability to communicate with other systems via communications means of varied types; and, memory 24** allows the system to retain data for use in building mailing lists or storing data for future use.

Figure 2:
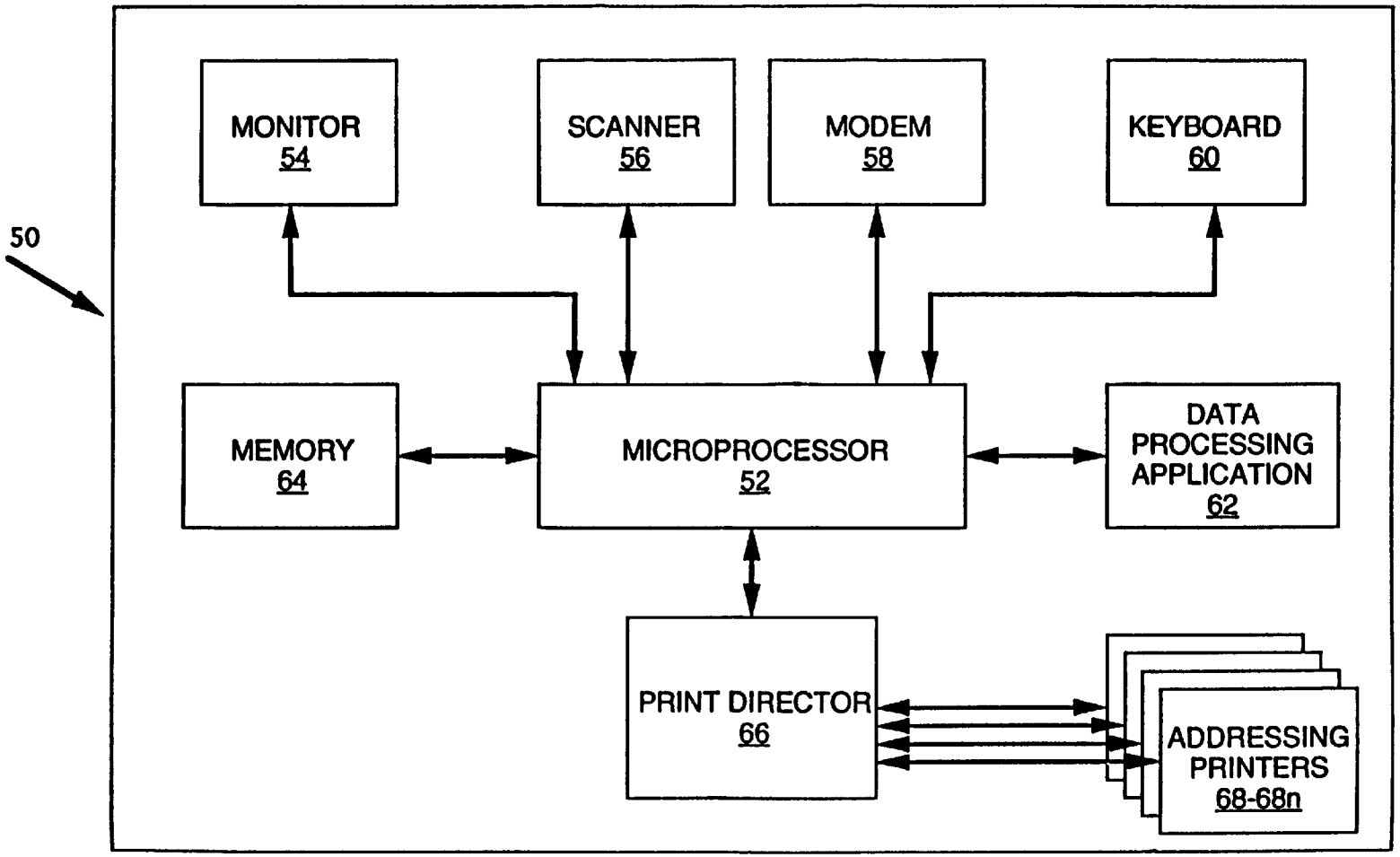
FIG. 2 is a block diagram of an alternative embodiment of the system within which the method of the present invention can reside and be utilized.

Turning to FIG. 2, there is shown a block diagram of an alternative embodiment of the current invention as addressing system 50 within which the method of the present invention could reside and be utilized.

System 50 comprises a microprocessor 52 interoperatively connected to monitor 54 for viewing the address data being collected to form the mail list. The viewing of the address data on monitor 54 promotes ease of use in word and data processing, and provides an example of the human interface that can be brought to system 50. Microprocessor 52 is interoperatively connected to scanner 56. Scanner 56 provides system 50 with the ability to scan address field data, barcodes, or other scannable data sources as an input to data processing application 62. Additionally, keyboard 60 is interoperatively connected to microprocessor 52 and serves as an input device for the creation of documents or the input of data. Modem 58 gives system 50 the ability to communicate with other systems via communications means of varied types; and, memory 64 allows the system to retain data for use in building mailing lists or storing data for future use.

Of particular importance to system 50 is the print director 66. Print director 66 is interoperatively connected to the microprocessor 52 and comprises LEDs and an integrated display to show: the status of each printer; current container number; current package number; current envelope number; and number of envelopes in a container. Print director 66 receives the print stream from microprocessor 52 and directs the stream to appropriate addressing printers **69–68*n*. Addressing printers 68–68*n* are interoperatively connected to print director 66** and serve as the output devices by which address data is printed to a substrate such as envelopes.

It should be noted that systems 10 and 50, as shown, can be expanded upon in a variety of ways to produce mailpieces more effectively, with greater throughput, or with more detail. Among the peripheral devices that can be effectively added to systems 10 and 50, in a variety of configurations are: inserters; sealers; and, postage meters.

Figure 3A:
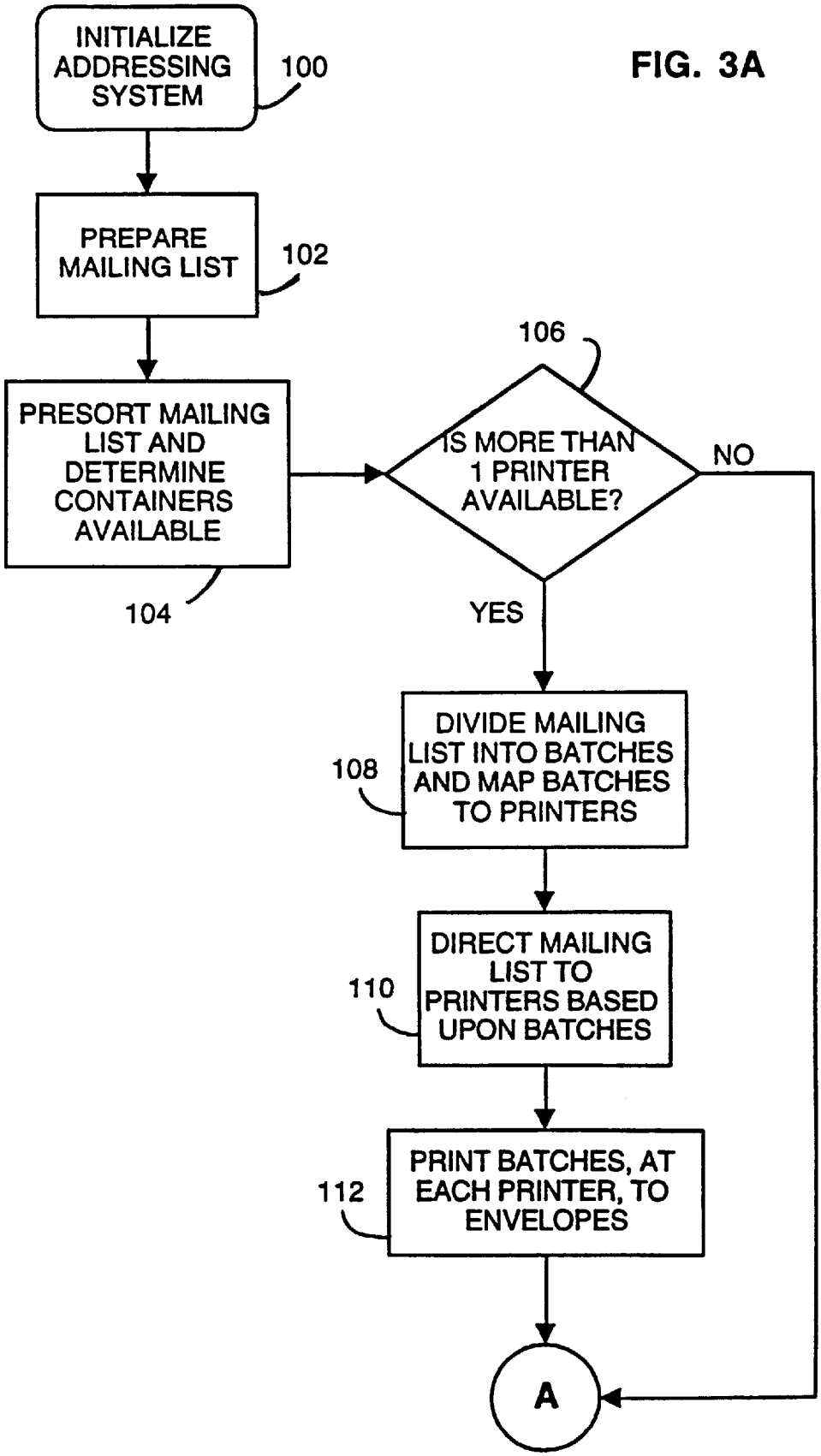
FIG. 3A is an upper level flowchart of the method for printing a mail list in presort order utilizing multiple printers.

Turning to FIG. 3A, there is shown an upper level flowchart of the method for printing a mail list in presort order utilizing multiple printers.

The method begins when the system user initializes the addressing system 10 at step 100. The method then advances to step 102 where a mailing list is prepared with the assistance of data processing application 22. Addressing applications, such as SmartMailer which is available from Pitney Bowes Inc. of Stamford, Conn., provide the system user with the ability to build effective mailing lists which can be assembled, barcoded, and address corrected so as to make optimal use of the discounts available from the postal service.

Once the mailing list has been prepared at step 102, the method advances to step 104 where the mailing list is pre-sorted in accordance with postal service regulations; thus, again achieving another level of efficiency to maximize available postal discounts. In the United States, the term-"presort" means sorted and prepared in accordance with one of the USPS approved methods listed in the Domestic Mail Manual (DMM). It is during the presort process that the type of container to be utilized, and the number, is determined. At step 104, the method determines which container types are to be made available for the printed envelopes to be placed into for delivery to the postal service. Additionally, the volume limit of the container is determined as based upon the characteristics of the mailpieces. The term "container" refers to any one of the container types approved by the USPS, such as: Mail Managed Tray (MM Tray); Extended Mail Managed Tray (EMM Tray), Flat Tray; or Sack. A "full container" is also defined by the USPS in the Domestic Mail Manual (DMM) and varies according to the presort method employed. A preferred embodiment of the presort setup process is discussed in greater detail with respect to FIG. 5.

Figure 3B:
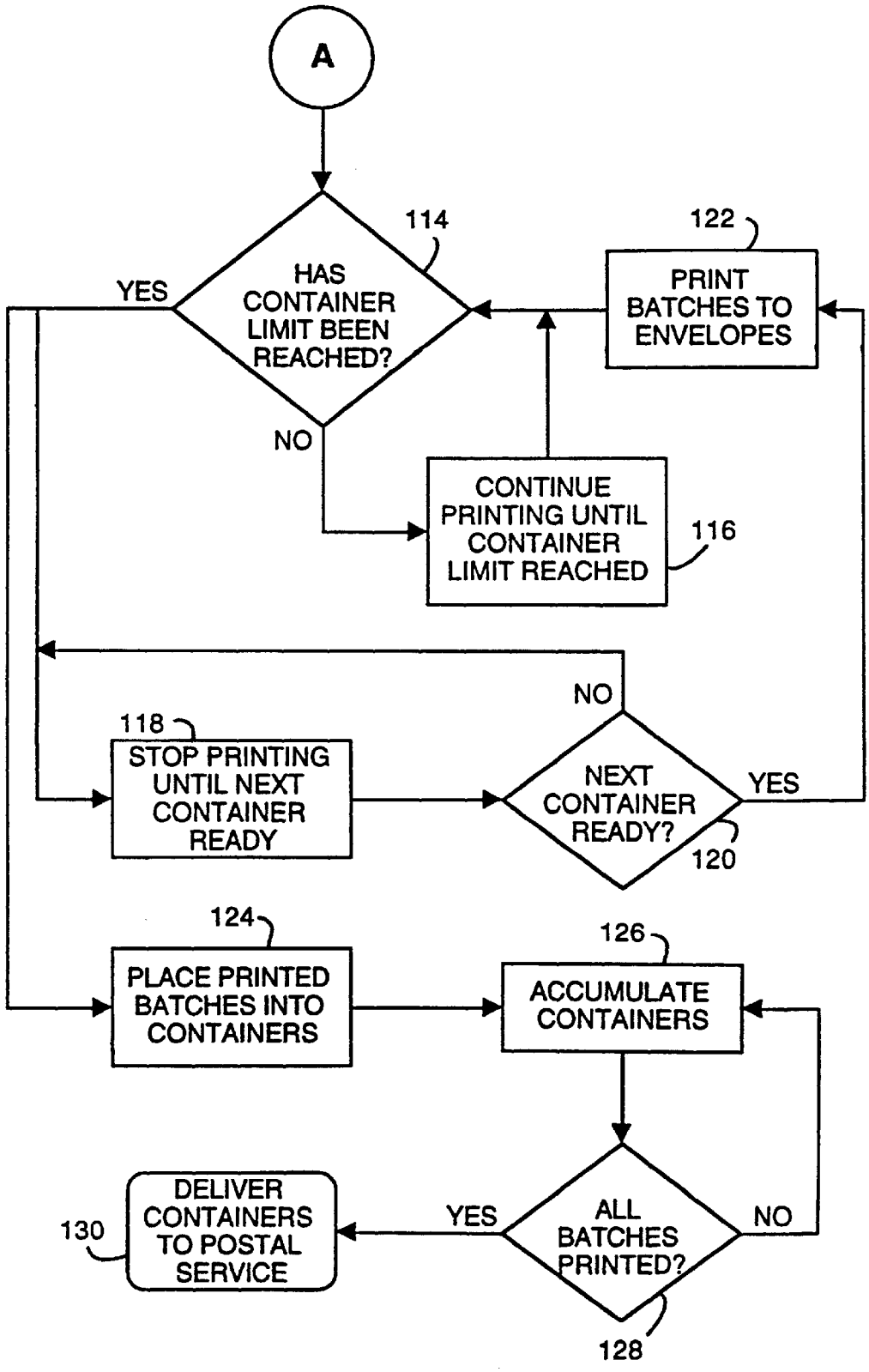
FIG. 3B is a continuation of flowchart 3A.

After the presort process, the presorted mail list would then normally be diverted to a printer for printing to envelopes or other substrates as required. However, the invention described herein maximizes the use of available printers by advancing to the query at question 106 which asks whether or not there is more than one (1) printer available for the print stream to be diverted to. If the response to the query at step 106 is "NO," then the method advances directly to path A which will re-enter the method flow at step 114 as is shown in FIG. 3B. If, however, the response to the query at step 106 is "YES," then the method advances to step 108.

At step 108, the method divides the mailing list into batches; each batch represents a full container printing load. The batches are then mapped to each of the available printers. The divided mailing list is then diverted at step 10 to the addressing printers **26–26*n***, based upon batch, for printing.

The printer determination is a key element of the subject invention. By determining, at steps 104, which containers are available and what there individual capacity is, the mailing list is divided between the printers **26–26*n* such that a batch directed to a printer for printing represents the full limit of the container available to that printer. In that way, at step 112, a batch is printed at the printer that matches the container limit; and, the system user can take the print run, load the container, and then direct the printer to print the next batch for the next available container. As each printer is printing its batch, every other printer available to the addressing system 10** is printing its corresponding batch.

The method then advances from step 112, along path A, to re-enter the method flow at step 114 as is shown in FIG. 3B.

The method of FIG. 3A is continued in FIG. 3B where path A re-enters the system flow at step 114.

Step 114 determines the completion of the batch printing by querying as to whether or not the container limit has been reached. If the response to the query is "YES," then the method advances directly to step 118 where the printer will stop printing until the next available container is ready to be filled by the system user. If, however, the response to the query at step 114 is"NO," then the method advances to step 116 where printing of the batch will continue until the batch limit, which is also the full container limit, is reached. It is possible, and contemplated by the invention herein, that sub-batches, of less than full container size, can be printed as the needs or requirements of the system user shifts. Printing would thus be paused as the desired batch or sub-batch is printed. The determination of the full container limit is determined by returning to the query at step 114.

Returning to step 118, the method then advances to the query at step 120 which asks if the next container is ready. If the response to the query is"NO," then the method returns to re-enter the flow at step 118 where printing is stopped until the container is ready. If the response to the query at step 120 is "YES," however, then the method advances to step 122 where the next batch is printed to envelopes or a similar substrate. From step 122, the method returns to the query at step 114.

Returning to step 114, if the response to the query is "YES," then occurring essentially simultaneously with the advancement to step 118 as previously discussed hereinabove, the method advances to step 124. At step 124, the system user places the printed batches into their corresponding containers. Of course, it should be noted that as an alternative to the system user placing the batch into the container, it is possible for a stacker or similar device to load the container. From step 124, the method accumulates containers at step 126 until each container is full; the method then advances to a query at step 128.

At step 128, the method queries as to whether or not all batches have been printed. If the response to the query is "NO," then the method returns to step 126 until the containers have been accumulated by the full batch print. If, however, the response to the query at step 128 is "YES," then the loaded container is delivered, at step 130, to the postal service.

Figure 4A:
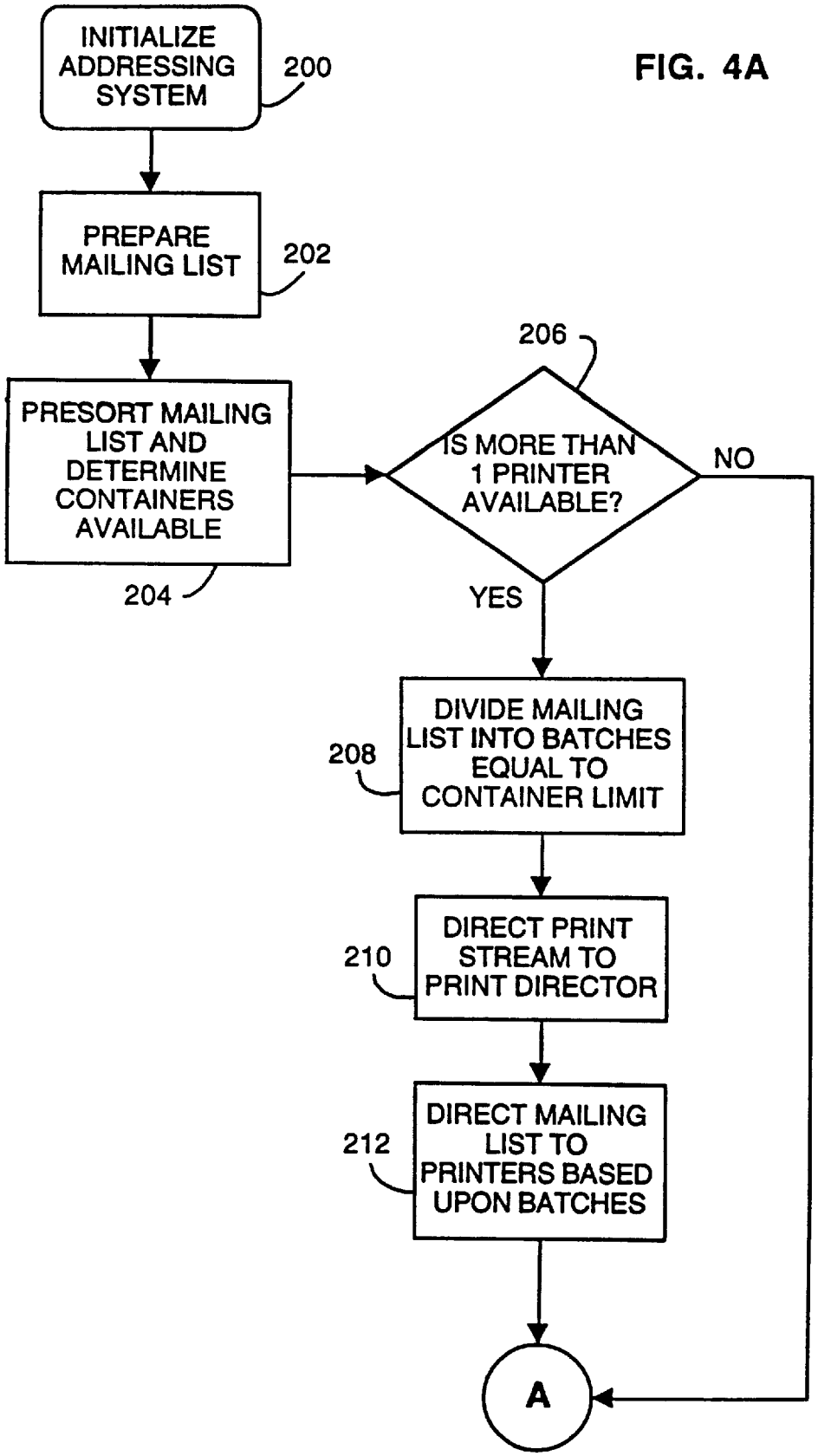
FIG. 4A is an upper level flowchart of the method for printing a mail list in presort order utilizing a print director to direct the data stream for printing to multiple printers.

Turning to FIG. 4A, there is shown an upper level flowchart of an alternative embodiment of the method for printing a mail list in presort order, wherein the embodiment utilizes a print director to direct the data stream for printing to multiple printers.

The method begins when the system user initializes the addressing system 50 at step 200. The method then advances to step 202 where a mailing list is prepared with the assistance of data processing application 62. Addressing applications, such as SmartMailer which is available from Pitney Bowes Inc. of Stamford, Conn., provide the system user with the ability to build effective mailing lists which can be assembled, barcoded, and address corrected so as to make optimal use of the discounts available from the postal service.

Once the mailing list has been prepared at step 202, the method advances to step 204 where the mailing list is pre-sorted in accordance with postal service regulations. In the United States, the term "presort" means sorted and prepared in accordance with one of the USPS approved methods listed in theDMM. It is during the presort process that the type of container to be utilized, and the number, is determined. At step 204, the method determines which container types are to be made available for the printed envelopes to be placed into for delivery to the postal service. Additionally, the volume limit of the container is determined as based upon the characteristics of the mailpieces. The term "container" refers to any one of the container types approved by the USPS, such as: MM Tray; EMM Tray, Flat Tray; or Sack. A "full container" is also defined by the USPS in the DMM and varies according to the presort method employed. A preferred embodiment of the presort setup process is discussed in greater detail with respect to FIG. 5.

Figure 4B:
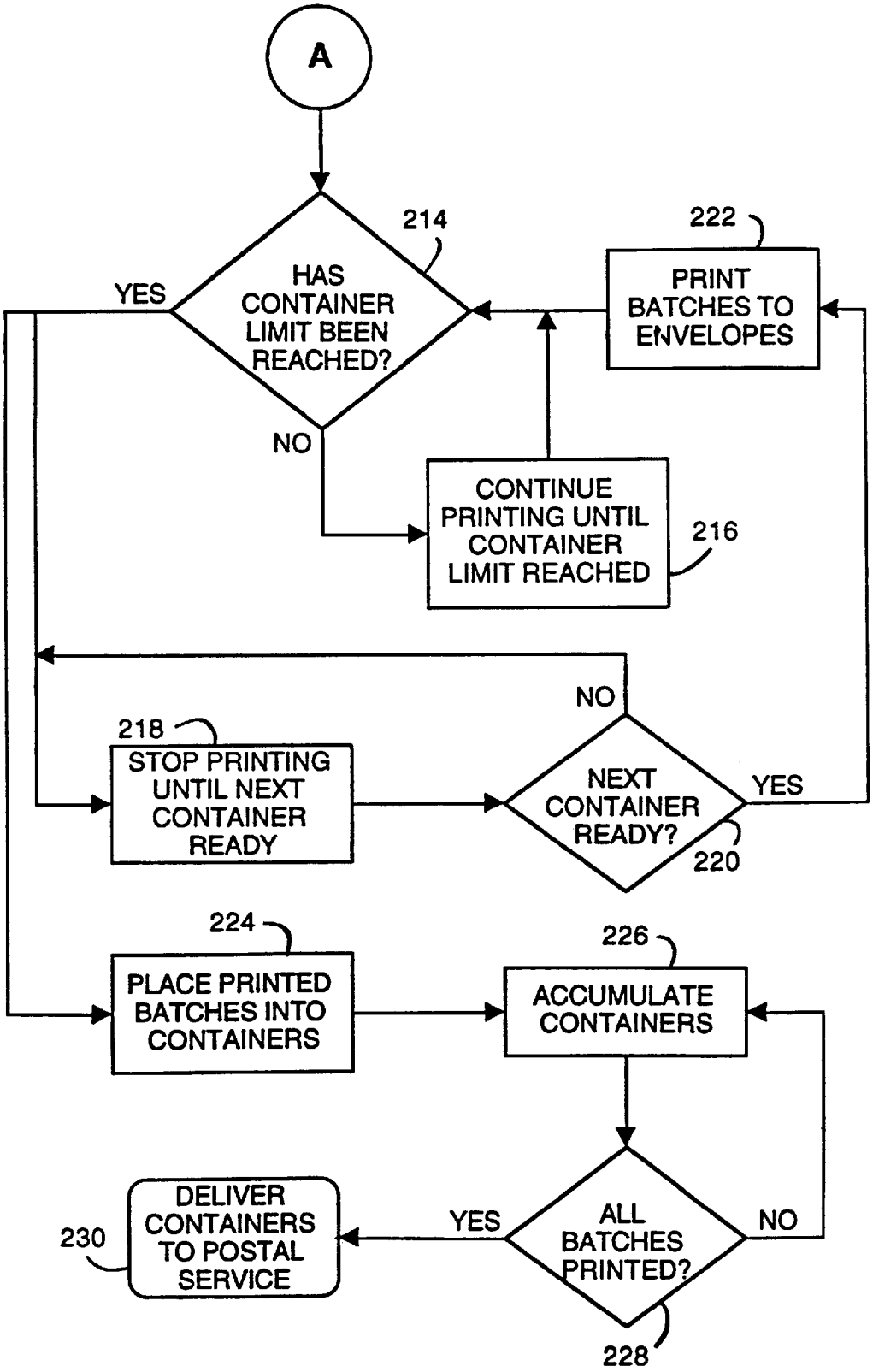
FIG. 4B is a continuation of flowchart 4A.

After the presort process, the presorted mail list would then normally be diverted to a printer for printing to envelopes or other substrates as required. However, the invention described herein maximizes the use of available printers by advancing to the query at question 206 which asks whether or not there is more than one (1) printer available for the print stream to be diverted to. If the response to the query at step 206 is "NO," then the method advances directly to path A which will re-enter the method flow at step 214 as is shown in FIG. 4B. If, however, the response to the query at step 206 is "YES," then the method advances to step 208.

At step 208, the method divides the mailing list into batches; each batch represents a full container printing load. The divided mailing list is then diverted at step 214 to the print director 66, for determination of how the batches will be directed to each of the printers 68–68*n*.

The printer determination, made by the print director 66 at step 212, is a key element of the subject invention. By previously determining, at step 204, which containers are available and what there individual capacity is, the mailing list is divided for direction of the print director 66 between the printers 68–68*n* such that a batch directed to a printer for printing represents the fill limit of the container available to that printer. In that way, at step 214, a batch is printed at the printer that matches the container limit; and, the system user can take the print run, load the container, and then direct the printer to print the next batch for the next available container. As each printer is printing its batch, every other printer available to the addressing system 50 is printing its corresponding batch.

The method then advances from step 212, along path A, to re-enter the method flow at step 214 as is shown in FIG. 4B.

The method of FIG. 4A is continued in FIG. 4B where path A re-enters the system flow at step 214.

Step 214 determines the completion of the batch printing by querying as to whether or not the container limit has been reached. If the response to the query is "YES," then the method advances directly to step 218 where the printer will stop printing until the next available container is ready to be filled by the system user. If, however, the response to the query at step 214 is"NO," then the method advances to step 216 where printing of the batch will continue until the batch limit, which is also the full container limit, is reached. It is possible, and contemplated by the invention herein, that sub-batches, of less than full container size, can be printed as the needs or requirements of the system user shifts. Printing would thus be paused as the desired batch or sub-batch is printed. The determination of the full container limit is determined by returning to the query at step 214.

Returning to step 218, the method then advances to the query at step 220 which asks if the next container is ready. If the response to the query is "NO," then the method returns to re-enter the flow at step 218 where printing is stopped until the container is ready. If the response to the query at step 220 is "YES," however, then the method advances to step 222 where the next batch is printed to envelopes or a similar substrate. From step 222, the method returns to the query at step 214.

Returning to step 214, if the response to the query is "YES," then occurring essentially simultaneously with the advancement to step 218 as previously discussed hereinabove, the method advances to step 224. At step 224, the system user places the printed batches into their corresponding containers. Of course, it should be noted that as an alternative to the system user placing the batch into the container, it is possible for a stacker or similar device to load the container. From step 224, the method accumulates containers at step 226 until each container is full; the method then advances to a query at step 228.

At step 228, the method queries as to whether or not all batches have been printed. If the response to the query is "NO," then the method returns to step 226 until the containers have been accumulated by the full batch print. If, however, the response to the query at step 228 is "YES," then the loaded container is delivered, at step 230, to the postal service.

Figure 5:
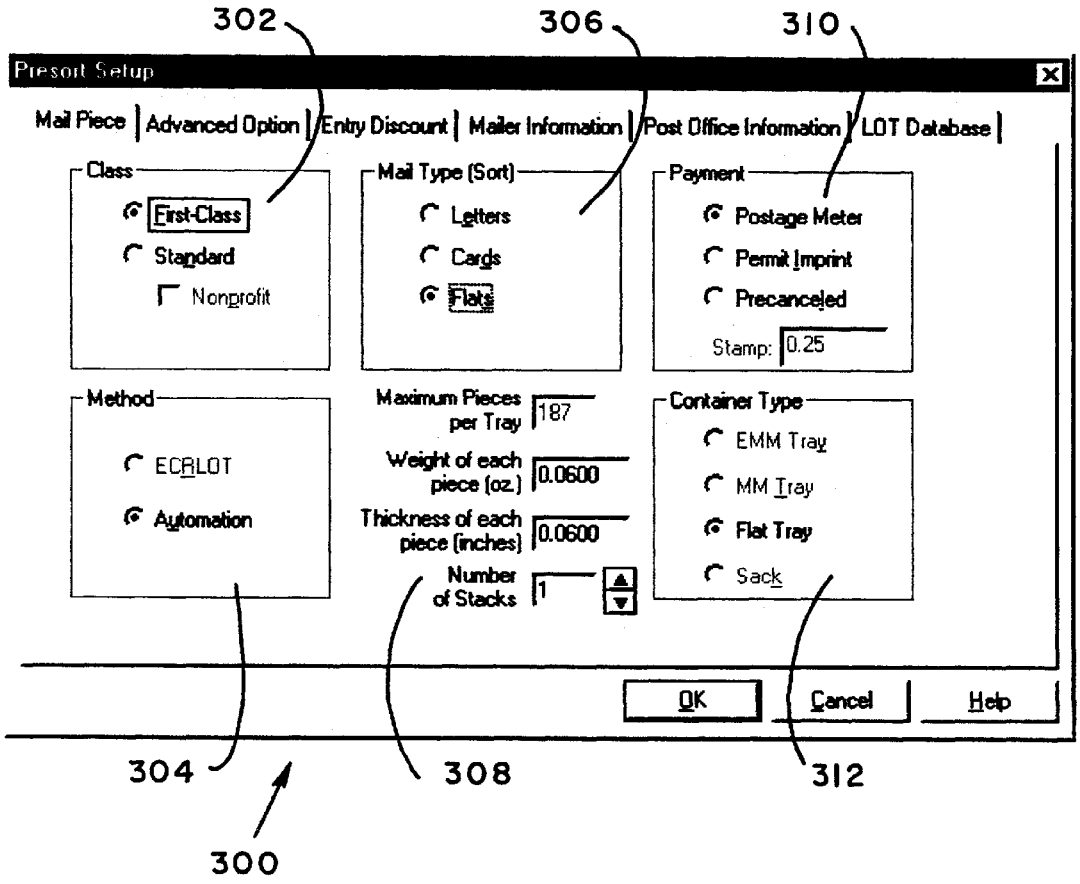
FIG. 5 is a print of the data processing application screen that prepares the system for presorting of a mail list print run.

Turning to FIG. 5, there is shown a screen print 300 of an embodiment of a presort setup method utilized by data processing applications 22 and 62 for preparing systems 10 and 50 for presorting of a mail list print run.

FIG. 5, in application screen 300, includes a number of parameters that can be determined by the system user in establishing a presort of the mailing list. The application requires that the class 302 of the mailpieces be determined by selecting from between first class and standard. A nonprofit class is available as well for those mailers who can claim postage discounts based upon that, classification. The selection of a presort method in block 304 allows the system user to select between ECRLOT and Automation. ECRLOT is the enhanced carrier route line of travel which is established by the postal service in accordance with the DMM. Automation is also defined by the DMM and is comprised of the highest discount levels available to mailers for complying with postal service automation requirements.

The type of mail for sortation is determined in block 306. The system user can select from among letters, cards, or flats as further defined in the DMM. The system user can then enter, in block 308, the weight of each individual mail piece within a batch and the thickness of each mailpiece. These values will be used to determine the maximum number of mailpieces per container. The system user can determine, in block 310, the payment method for the applicable postage. The available container types for the categories of mail selected in each of blocks 302, 304, 306, 308, and 310 will be shown to the system user in block 312.

While certain embodiments have been described above in terms of the system within which the address object methods may reside, the invention is not limited to such a context. The systems shown in FIGS. 1 and 2 are one example of host systems for the invention method; and, the system elements are intended merely to exemplify the type of peripherals and software components that can be used with the invention.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A method of printing a mail list in presort order, on a plurality of printers, comprising the steps of:

(a) preparing said mailing list within an addressing system;

(b) presorting said mail list in accordance with predefined postal service requirements;

(c) dividing said presorted mail list into batches by container type wherein the maximum mailpiece capacity of said container defines the point at where said presorted mail list is divided;

(d) directing said divided mail list to said plurality of printers for printing to an envelope wherein each of said plurality of printers is selected based upon said batches;

(e) printing a batch of mailpieces at a particular printer wherein said printer is configured to print based upon a corresponding container type and wherein said batch size equals said corresponding container's capacity;

(f) placing said printed batch of mailpieces into said corresponding container; and (g) delivering said corresponding container to said postal service.

2. The method of claim 1, wherein said presort order is based upon a postal service defined code assigned to each of said mailpieces within said batch.

3. The method of claim 1, wherein said container type is determined by one or more container types available to a mailer utilizing said addressing system and wherein said one or more available container types are in conformance with postal service regulations for containing presorted mail.

4. The method of claim 1, wherein said addressing system comprises:

(a) a microprocessor;

(b) a memory;

(c) an addressing software application;

(d) a monitor under control of said addressing software application; and (e) communication means for communicating with one or more devices peripheral to said microprocessor.

5. The method of claim 1, wherein said addressing system is capable of accepting a set of data, wherein said set of data is representative of a plurality of addresses.

6. The method of claim 1, wherein said addressing system is capable of combining a plurality of addresses, input from one or more data sources, to form said mail list.

7. The method of claim 5, wherein said addressing system is capable of preparing said mail list by combining said set of data with previously accepted data to form said mail list.

8. The method of claim 1, wherein said particular printer pauses after completion of said batch printing and notifies a system user that said batch has been printed; and, wherein said particular printer does not print a next batch until allowed to do so by said system user.

9. The method of claim 4, wherein said monitor displays a plurality of status indicators, under control of said addressing software application, wherein said status indicators comprise:

(a) a status of each of said plurality of printers;

(b) a first sequence number for each of said containers awaiting placement of said printed batch of mailpieces;

(c) a second sequence number for each of a set of sub-batch packages;

(d) a third sequence number for each envelope being printed by each of said plurality of printers; and (e) a fourth sequence number representing the total number of envelopes placed in each of said containers.

10. A system for printing a mail list in presort order on a plurality of printers, comprising:

(a) mail list preparation means for accepting and/or assembling said mail list;

(b) mail list sorting means for placing the contents of said mail list in presort order in accordance with postal service requirements;

(c) calculation means for calculating a set of breakpoints in said mail list to form batches, and wherein each of said breakpoints is determined by a container type;

(d) direction means for directing said mail list to a plurality of printing means, wherein said direction is based upon said batches;

(e) a plurality of printing means for printing a batch of mailpieces at a particular printer wherein said printer is configured to print based upon a corresponding container type and wherein said batch size equals said corresponding container's capacity; and (f) handling means for taking said printed batch of mailpieces and placing said batch into said corresponding container and delivering said corresponding container to said postal service.

11. The method of claim 10, wherein said system further comprises:

(a) a microprocessor;

(b) a memory;

(c) an addressing software application; and (d) a monitor under control of said addressing software application; and (e) communication means for communicating with one or more devices peripheral to said microprocessor.

12. The system of claim 10, wherein said mail list preparation means is capable of accepting a set of data, wherein said set of data is representative of a plurality of addresses.

13. The system of claim 10, wherein said mail list preparation means is capable of combining a plurality of addresses, input from one or more data sources, to form said mail list.

14. The system of claim 12, wherein said mail list preparation means is capable of preparing said mail list by combining said set of data with previously accepted data to form said mail list.

15. The system of claim 11, wherein said addressing software application comprises said mail list preparation means.

16. A method of printing a mail list, in presort order, on a plurality of printers, comprising the steps of:

(a) preparing said mailing list within an addressing system;

(b) presorting said mail list in accordance with predefined postal service requirements;

(c) dividing said presorted mail list into batches by container type wherein the maximum mailpiece capacity of said container defines the point at where said presorted mail list is divided;

(d) directing said divided mail list to a print director-wherein said print director is operatively connected to said addressing system;

(e) diverting said divided mail list to each of a plurality of printers for printing to an envelope, wherein each of said plurality of printers is selected by said print director based upon said batches;

(f) printing a batch of mailpieces at a particular printer wherein said printer is configured to print based upon a corresponding container type and wherein said batch size equals said corresponding container's capacity;

(g) placing said printed batch of mailpieces into said corresponding container; and (h) delivering said corresponding container to said postal service.

17. The method of claim 16, wherein said print director comprises:

(a) first connecting means for connecting said print director to said addressing system;

(b) second connecting means for connecting said print director to each of said plurality of printers;

(c) first communication means for communicating with said addressing system via said first connecting means;

(d) second communication means for communicating with each of said plurality of printers via said second connecting means; and (e) direction means for directing said batch of mailpieces to be printed by said particular printer based upon said corresponding container.

* * * * *